US007950796B2

(12) United States Patent
Oyanagi et al.

(10) Patent No.: US 7,950,796 B2
(45) Date of Patent: May 31, 2011

(54) LIGHT EMITTING DEVICE, METHOD OF MANUFACTURING LIGHT EMITTING DEVICE, AND INK JET RECORDING APPARATUS

(75) Inventors: Takashi Oyanagi, Shiojiri (JP); Keitaro Nakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 641 days.

(21) Appl. No.: 11/872,863

(22) Filed: Oct. 16, 2007

(65) Prior Publication Data

US 2008/0211893 A1 Sep. 4, 2008

(30) Foreign Application Priority Data

Oct. 18, 2006 (JP) ..... 2006-283477

(51) Int. Cl.
*B41J 2/01* (2006.01)
*F21V 29/00* (2006.01)
*H01J 9/00* (2006.01)

(52) U.S. Cl. ..... 347/102; 362/373; 445/23

(58) Field of Classification Search ..... None
See application file for complete search history.

(56) References Cited

U.S. PATENT DOCUMENTS

| | | | | |
|---|---|---|---|---|
| 6,582,100 | B1 | 6/2003 | Hochstein et al. | |
| 2005/0077616 | A1 | 4/2005 | Ng et al. | |
| 2005/0280683 | A1* | 12/2005 | Custer | 347/102 |
| 2006/0203024 | A1* | 9/2006 | Kusunoki | 347/15 |

FOREIGN PATENT DOCUMENTS

| | | |
|---|---|---|
| EP | 1552983 | 7/2005 |
| EP | 1647766 | 4/2006 |
| GB | 2420221 | 5/2006 |
| JP | 2002-093206 | 3/2002 |
| JP | 2004-237456 | 8/2004 |
| JP | 2005-119270 | 5/2005 |
| JP | 2005-310892 | 11/2005 |
| KR | 10-2006-0009021 A | 1/2006 |
| KR | 10-2006-0098180 A | 9/2006 |

* cited by examiner

*Primary Examiner* — Stephen D Meier
*Assistant Examiner* — Alexander C Witkowski
(74) *Attorney, Agent, or Firm* — Workman Nydegger

(57) ABSTRACT

A light emitting device includes a substrate, a light emitting body, a thermally conductive member, and a heat radiation member. The substrate has a first face and a second face which is a face opposite to the first face. The light emitting body is held on a side of the first face of the substrate and emits light. The thermally conductive member is provided so as to be in contact with the second face of the substrate and contains a high thermal conductive material. The heat radiation member is provided so as to be in contact with the thermally conductive member and radiates heat conducted from the substrate through the thermally conductive member.

5 Claims, 15 Drawing Sheets

LIGHT EMITTING DEVICE, METHOD OF MANUFACTURING LIGHT EMITTING DEVICE, AND INK JET RECORDING APPARATUS

BACKGROUND

1. Technical Field

The present invention relates to a light emitting device, a method of manufacturing a light emitting device, and an ink jet recording apparatus.

2. Related Art

There is a known ink jet recording apparatus that discharges ink, which hardens by receiving light, (hereinafter, referred to as photo curable ink) onto a recording medium in form of ink droplets and, therefore, the ink jet recording apparatus is able to form an image on the recording medium using the photo curable ink. It has been known that the existing ink jet recording apparatus includes a light irradiation device (hereinafter, referred to as light emitting device) that irradiates light to the photo curable ink that has been discharged onto the recording medium and a cooling fan that cools the light emitting device by blowing onto the light emitting device, which is, for example, described in Japanese Unexamined Patent Application Publication No. 2004-237456 (particularly, in FIG. 1 to FIG. 3).

In the ink jet recording apparatus described in JP-A-2004-237456, a light emitting device is provided on each side of a recording head, and a cooling fan is provided above each of the light emitting devices.

With this configuration, owing to a blowing air from the cooling fan, it is likely to generate a flow of air in proximity to the recording head. As the flow of air is generated in proximity to the recording head, it may cause ink droplets discharged from the recording head to curvedly fly, which is a phenomenon that a flying path of the ink droplets curves.

That is, in the ink jet recording apparatus described in JP-A-2004-237456, there is a problem that it is difficult to reduce the occurrence of curved flying of ink droplets.

SUMMARY

An advantage of some aspects of the invention is that it provides a light emitting device that is able to reduce a flow of air and a method of manufacturing the light emitting device and also provides an ink jet recording apparatus that is able to reduce the occurrence of the curved flying.

A first aspect of the invention provides a light emitting device. The light emitting device includes a substrate, a light emitting body, a thermally conductive member, and a heat radiation member. The substrate has a first face and a second face which is a face opposite to the first face. The light emitting body is held on a side of the first face of the substrate and emits light. The thermally conductive member is provided so as to be in contact with the second face of the substrate and contains a high thermal conductive material. The heat radiation member is provided so as to be in contact with the thermally conductive member and radiates heat conducted from the substrate through the thermally conductive member.

In this light emitting device, because the thermally conductive member is interposed between the heat radiation member and the substrate that holds the light emitting body so that the thermally conductive member is in contact with the substrate and the heat radiation member, it is possible to easily conduct heat of the substrate to the heat radiation member. That is, in this aspect of the invention, it is possible to promote heat of the substrate to be released from the heat radiation member. Thus, it is possible to reduce a blowing air for actively cooling the substrate.

In the above light emitting device, the thermally conductive member may be formed into a sheet-like shape and may cover a region that overlaps the light emitting body in plan view, and the thermally conductive member may be held between the second face and the heat radiation member.

In this light emitting device, the sheet-like thermally conductive member covers the region that overlaps the light emitting body on the second face of the substrate. That is, the thermally conductive member covers the region of the second face of the substrate, through which heat from the light emitting body is easily conducted. Thus, it is possible to further promote heat of the substrate to be conducted to the heat radiation member.

In the above light emitting device, the heat radiation member may be provided with a fin that extends away from the thermally conductive member.

In this light emitting device, the surface area of the heat radiation member may be increased, so that it is possible to easily radiate heat that is conducted to the heat radiation member.

In the above light emitting device, the substrate, the thermally conductive member and the heat radiation member may be bound by a holding bracket.

In this light emitting device, because the substrate, the thermally conductive member and the heat radiation member are bound, the substrate, the thermally conductive member and the heat radiation member less likely to receive resistance when they thermally expand. Thus, it is possible to reduce deformation that occurs due to a difference in coefficient of thermal expansion among the substrate, the thermally conductive member and the heat radiation member.

A second aspect of the invention provides a method of manufacturing a light emitting device that includes a substrate that has a first face, on which a light emitting body that emits light is mounted, and a second face opposite to the first face, a thermally conductive sheet that contains a high thermal conductive material, and a heat radiation member formed from a high thermal conductive material into a sheet-like shape. The method includes stacking the substrate, the thermally conductive sheet and the heat radiation member so as to form a stacked body including the substrate, the thermally conductive sheet and the heat radiation member, in such a manner that the thermally conductive sheet is in contact with the second face and the heat radiation member is in contact with the thermally conductive sheet, and binding the stacked body including the substrate, the thermally conductive sheet and the heat radiation member. When binding the stacked body, in a state where a plate material having a size that exceeds a thickness of the stacked body is opposed to a side periphery of the stacked body, the plate material is bent toward the stacked body to hold the substrate and the heat radiation member with the plate material.

In this method of manufacturing the light emitting device, it is possible to manufacture a light emitting device that is less likely to receive resistance when the substrate, the thermally conductive member and the heat radiation member thermally expand.

A third aspect of the invention provides an ink jet recording apparatus. The ink jet recording apparatus includes any one of the above described light emitting devices and a discharge head that discharges ink, which hardens by receiving light emitted from the light emitting body, toward a recording medium. The light emitting device irradiates the light to the ink that is discharged from the discharge head and adhered to the recording medium.

In this ink jet recording apparatus, because the light emitting device that is able to promote heat of the substrate to be released from the heat radiation member is provided, it is possible to reduce a blowing air for actively cooling the light emitting device, and it is possible to reduce a curved flying of ink discharged from the discharge head.

The above ink jet recording apparatus may further include a feed device, a cover and a blower. The feed device feeds the recording medium while having the recording medium opposed to the discharge head. The cover covers the light emitting device so that the light emitting body is exposed. The blower introduces outside air present outside the cover into the cover. The light emitting device is arranged downstream of the discharge head in a direction in which the recording medium is fed so that the light emitting body exposed from the cover is opposed to the recording medium fed by the feed device. The cover has an exhaust port formed therein so as to exhaust air inside the cover toward downstream the discharge head.

In this ink jet recording apparatus, the light emitting device may be covered with the cover in a state where the light emitting body is exposed. The exhaust port is formed in the cover, and outside air is introduced thereinto by the blower. Air inside the cover is exhausted through the exhaust port toward downstream in the direction in which the recording medium is transported. That is, in this aspect of the invention, a flow of air may be generated inside the cover and heat radiation of the heat radiation member may be promoted, and, in addition, because air inside the cover is exhausted toward the downstream side, it is possible to suppress a flow of air in proximity to the discharge head to a lesser degree.

In the above ink jet recording apparatus, the blower may be an air intake fan that introduces the outside air into the cover.

In this ink jet recording apparatus, because outside air may be easily brought to the heat radiation member using the air intake fan, it is possible to further promote heat radiation of the heat radiation member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
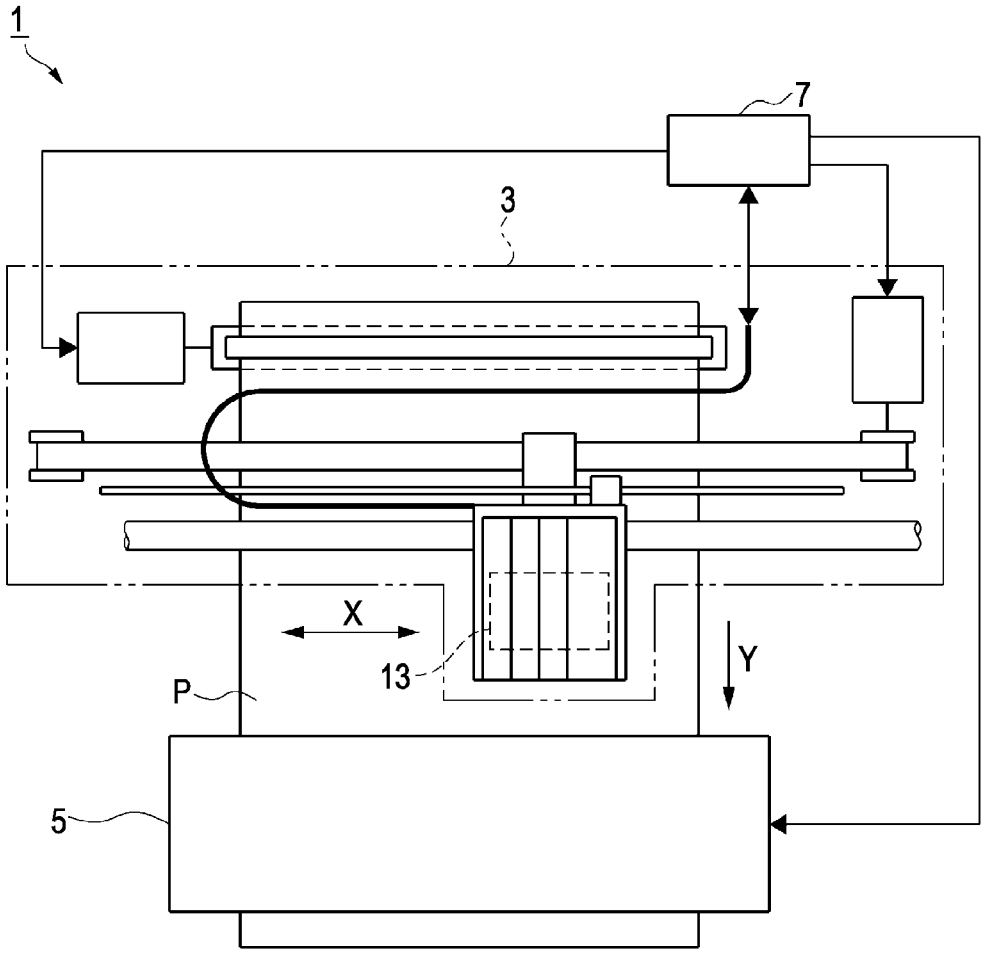
FIG. 1 is a plan view that schematically shows the configuration of an ink jet recording apparatus according to an embodiment of the invention.

An ink jet recording apparatus 1 according to an embodiment of the invention, as shown in a plan view of FIG. 1, includes an image forming device 3, a light emitting device 5 and a control circuit 7.

Figure 2A:
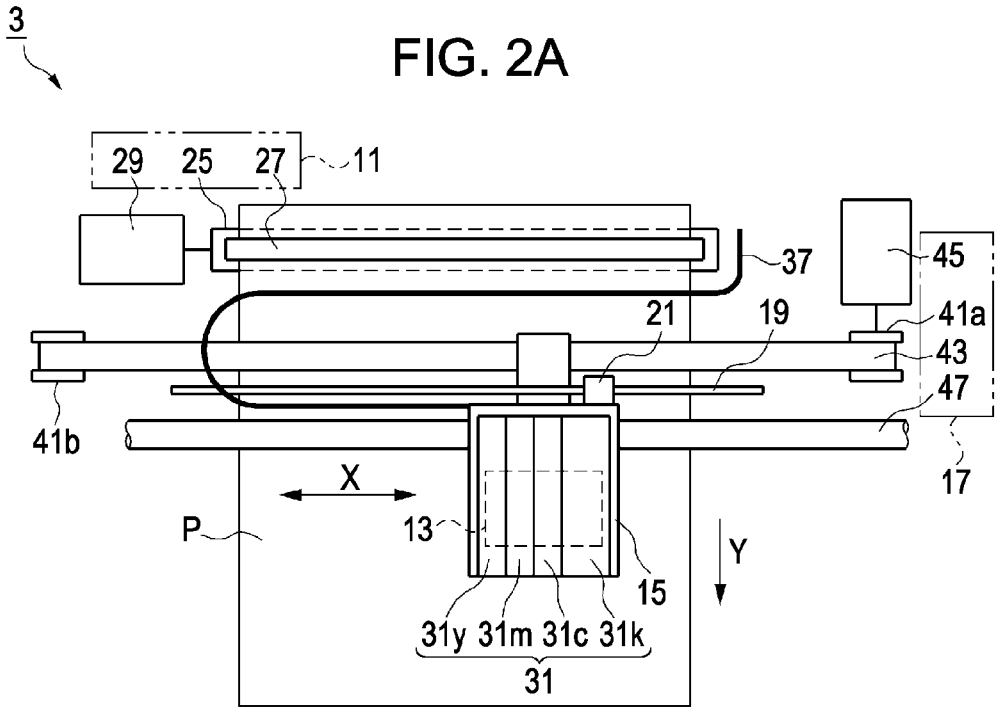
FIG. 2A and FIG. 2B are views that illustrate the configuration of an image forming device of the ink jet recording apparatus according to the embodiment of the invention.
Figure 2B:
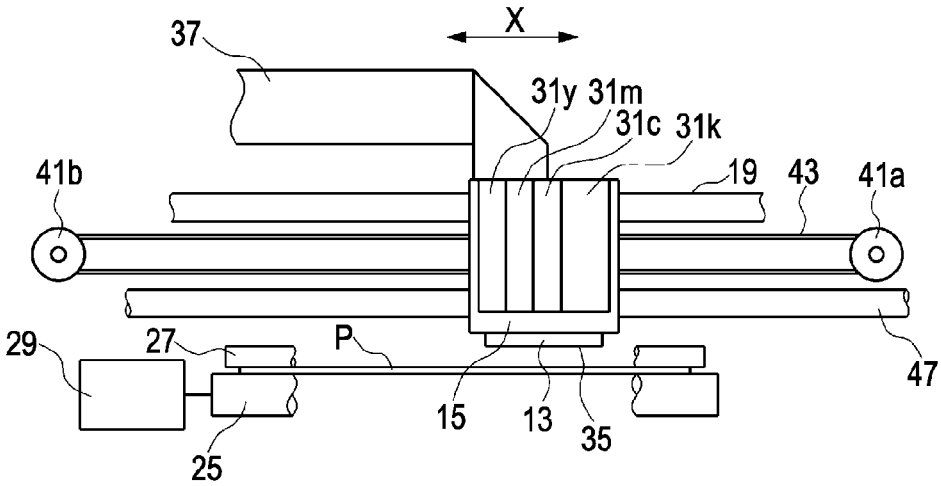

The image forming device 3, as shown in a plan view of FIG. 2A and in a front view of FIG. 2B, includes a feed device 11, a recording head 13, a carriage 15, a carriage moving device 17, a linear scale 19 and a linear encoder 21.

The feed device 11 includes a feed roller 25, a press roller 27 and a feed motor 29. The feed roller 25 and the press roller 27, of which outer peripheries are in contact with each other, are configured to be rotatable. The operation of the feed motor 29 is controlled by the control circuit 7. The feed motor 29 generates power to drive the feed roller 25 for rotation.

The thus configured feed device 11, when power is transmitted from the feed motor 29 to the feed roller 25, intermittently feeds a recording sheet of paper P, which is pinched between the feed roller 25 and the press roller 27, in a Y direction, which is a feeding direction.

The recording head 13 has a plurality of nozzles formed in its bottom face and discharges ink from the plurality of nozzles in form of ink droplets on the basis of a driving signal output from the control circuit 7. Note that, in the present embodiment, ultraviolet curing ink, which hardens by receiving ultraviolet ray, is employed. The ultraviolet curing ink is contained in an ink cartridge 31. The ink cartridge 31 separately contains yellow ink, magenta ink, cyan ink and black ink in respective cartridges 31*y*, 31*m*, 31*c* and 31*k*.

Here, the arrangement of nozzles formed in the recording head 13 will be described. The recording head 13, as shown in a bottom plan view of FIG. 3, has multiple number of nozzles 33. These multiple number of nozzles 33 form eight columns of nozzles L1, L2, L3, L4, L5, L6, L7 and L8, each of which extends in the Y direction. Each of the nozzle columns L1 to L8 includes a plurality of the nozzles that are formed so as to be arranged at predetermined intervals in the Y direction.

These nozzle columns L1 to L8 are formed in units of two columns in correspondence with each ink color. That is, the nozzles 33 that form the nozzle columns L1 and L2 discharge black ink droplets. The nozzles 33 that form the nozzle columns L3 and L4 discharge cyan ink droplets. The nozzles 33 that form the nozzle columns L5 and L6 discharge magenta ink droplets. The nozzles 33 that form the nozzle columns L7 and L8 discharge yellow ink droplets.

In addition, the nozzle column L1 and the nozzle column L2 are offset from each other so that the nozzles 33 of the nozzle column L1 and the nozzles 33 of the nozzle column L2 are alternately arranged in the Y direction. That is, the nozzles 33 that form the nozzle columns L1 and L2 are arranged in a zigzag manner. Similarly, the nozzles 33 in each of the pair of nozzle columns L3 and L4, the pair of nozzle columns L5 and L6 and the pair of nozzle columns L7 and L8 are also arranged in a zigzag manner.

Figure 3:
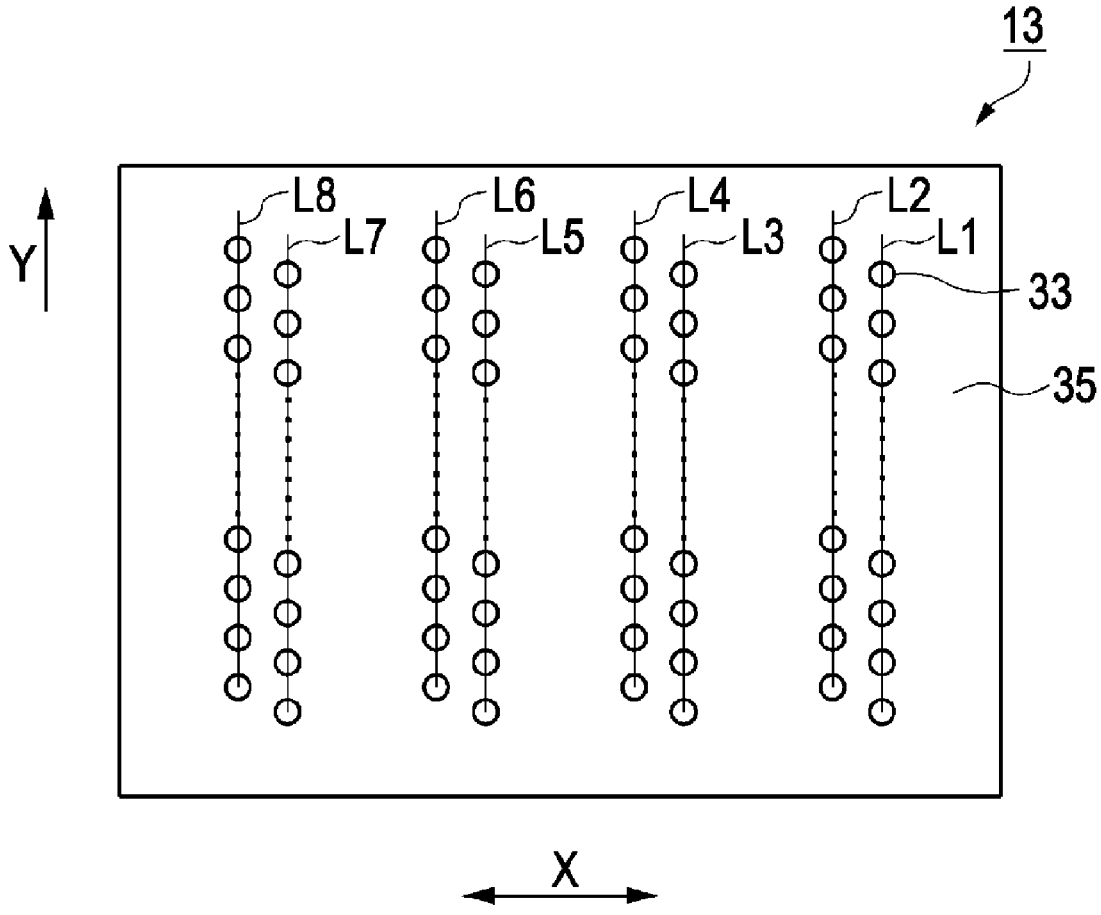
FIG. 3 is a bottom plan view of a recording head of the ink jet recording apparatus according to the embodiment of the invention.

Note that, in FIG. 3, the size of each nozzle 33 is exaggeratedly shown and the number of the nozzles 33 is reduced for easy illustration of the nozzles 33. In addition, the reference numeral 35 in FIG. 3 denotes a nozzle face that is a face of the recording head 13, which will be opposed to the recording sheet of paper P.

The carriage 15, as shown in FIG. 2A and FIG. 2B, detachably holds the above described cartridges 31*y*, 31*m*, 31*c* and 31*k*, and the recording head 13 is arranged on the lower face of the carriage 15. Note that the recording head 13, as shown in FIG. 2B, is arranged on the carriage 15 so that the nozzle face 35 are directed toward the recording sheet of paper P and a clearance is maintained between the nozzle face 35 and the recording sheet of paper P. In addition, a driving signal output from the control circuit 7 is transmitted through a cable 37 to the recording head 13.

The carriage moving device 17, as shown in FIG. 2A, includes a pair of pulleys 41*a*, 41*b*, a timing belt 43, a carriage motor 45 and a carriage guide shaft 47. The timing belt 43 is wound around the pair of pulleys 41*a*, 41*b* along an X direction, which is a main scanning direction, and is partially fixed to the carriage 15.

The operation of the carriage motor 45 is controlled by the control circuit 7. The carriage motor 45 generates power to drive the pulley 41*a* for rotation. The carriage guide shaft 47 extends in the X direction, and both ends of the carriage guide shaft 47 are supported by a case (not shown). The carriage guide shaft 47 guides the carriage 15 in the X direction.

The thus configured carriage moving device 17, when power is transmitted from the carriage motor 45 through the pulley 41*a* and the timing belt 43 to the carriage 15, reciprocally moves the carriage 15 in the X direction.

Here, the image forming device 3 is provided with the linear scale 19 that extends in the X direction. The linear scale 19 has a lot of marks of the scale provided at predetermined intervals along the X direction. In addition, the carriage 15 is provided with the linear encoder 21 that optically detects a mark of the scale provided on the linear scale 19.

In the image forming device 3, the position of the carriage 15 in the X direction is controlled on the basis of the scale detected by the linear encoder 21. Note that a detection signal that the linear encoder 21 detects the scale is transmitted through the cable 37 to the control circuit 7.

Figure 4A:
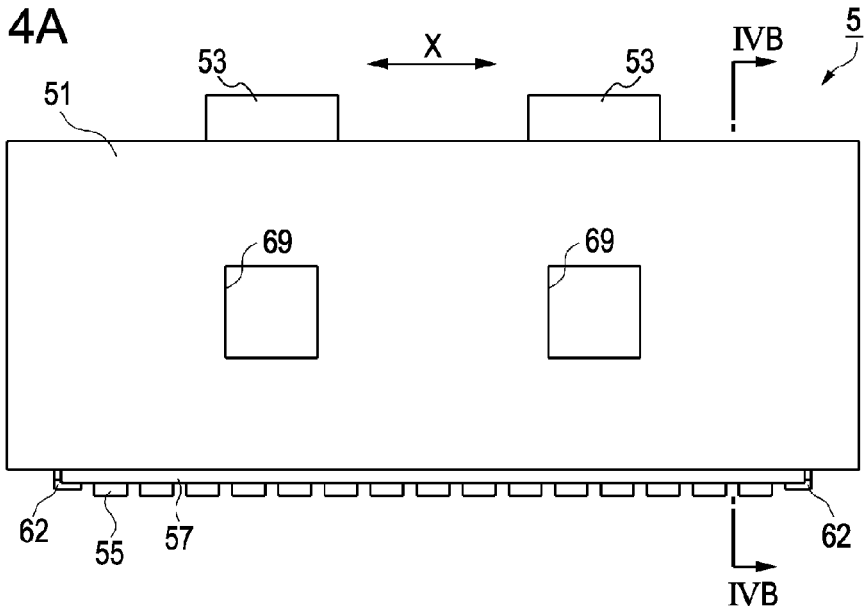
FIG. 4A and FIG. 4B are views that illustrate the configuration of a light emitting device of the ink jet recording apparatus according to the embodiment of the invention.
Figure 4B:
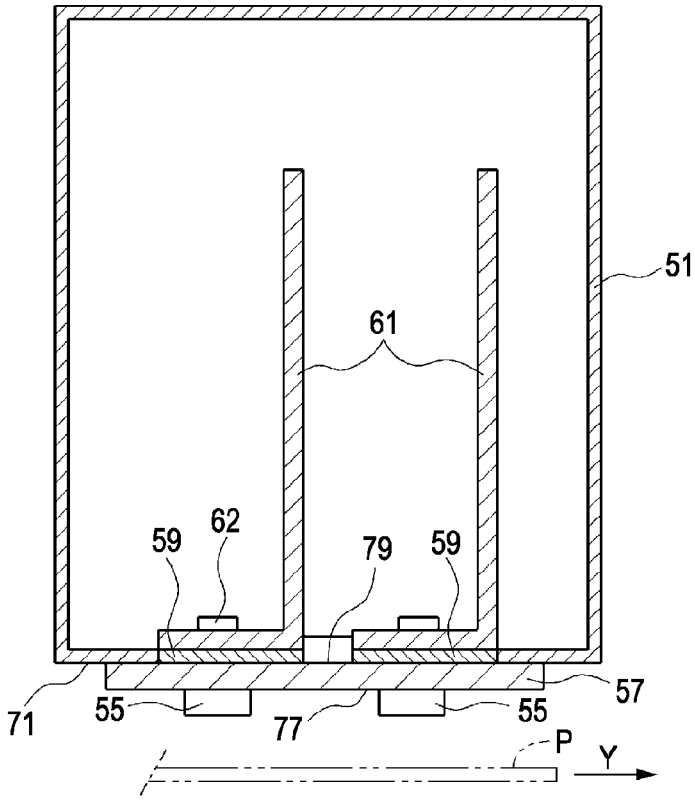

The light emitting device 5, as shown in a front view of FIG. 4A and a cross-sectional view, taken along the line IVB-IVB in FIG. 4A, of FIG. 4B, includes a cover 51, two fan motors 53, a plurality of light emitting elements 55, a substrate 57, two thermally conductive members 59, two heat sinks 61 and two holding brackets 62. Note that, in FIG. 4B, the fan motors 53 are omitted.

Figure 5A:
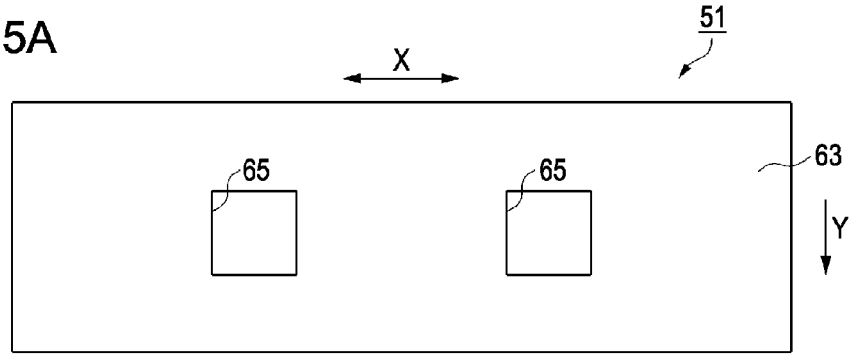
FIG. 5A to FIG. 5C are views that show the appearance of a cover of the light emitting device of the ink jet recording apparatus according to the embodiment of the invention.
Figure 5B:
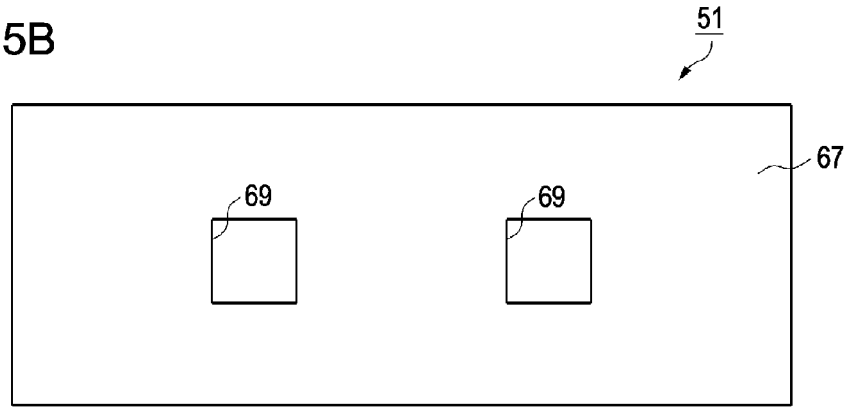

The cover 51 is formed into a hollow box shape, and, as shown in a plan view of FIG. 5A, two air intake holes are formed in a top plate face 63 of the cover 51 so as to be aligned along the X direction. In addition, as shown in a front view of FIG. 5B, two exhaust holes 69 are formed in a front face 67 of the cover 51 so as to be aligned along the X direction.

Figure 5C:
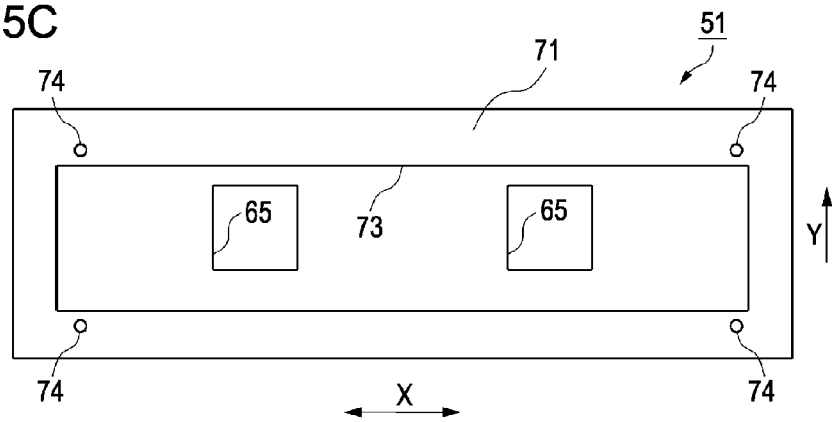

As shown in a bottom plan view of FIG. 5C, an insertion opening 73, into which the thermally conductive members 59 and the heat sinks 61 are inserted, is formed in a bottom face 71 of the cover 51. Note that the reference numeral 74 shown in FIG. 5C denotes screw holes for fixing the substrate 57.

The two fan motors 53 each are formed of a motor having a built-in propeller. The operation of the fan motors 53 is controlled by the control circuit 7. Each of the fan motors 53 is arranged on the top plate face 63 of the cover 51 at a position that covers the corresponding air intake hole 65. These fan motors 53 each are controlled to rotate in a direction in which air present outside the cover 51 (hereinafter, outside air) is introduced into the cover 51.

The plurality of light emitting elements 55 each are controlled by the control circuit 7 so as to enter an on state or an off state, and, when in an on state, emit light. Light emitted from the light emitting elements 55 includes ultraviolet ray having a wavelength that promotes hardening of ultraviolet curing ink. The light emitting elements 55 may employ an element, such as a LED (light emitting diode) and an LD (laser diode), for example. In the present embodiment, a surface-mount LED is employed as the light emitting element 55. Then, the plurality of light emitting elements 55, as shown in FIG. 4B, are surface-mounted on a first face 77 of the substrate 57.

Note that, in the description, light not only includes visible light but also includes electromagnetic waves having various wavelengths. In addition, in the present embodiment, it is only necessary that light emitted from the light emitting elements 55 includes ultraviolet ray having a wavelength that promotes hardening of ink. Thus, the light emitting elements 55 may employ both the one that emits ultraviolet ray only and the one that emits ultraviolet ray and electromagnetic wave of another wave range.

The substrate 57, as shown in FIG. 4B, extends over the insertion opening 73 of the cover 51 in the Y direction and is fixed to the cover 51 with a fixing member, such as a screw (not shown), in a state where the second face 79 is in contact with the lower face of the cover 51. Thus, the plurality of light emitting elements 55 are kept exposed from the cover 51.

Here, the arrangement of the plurality of light emitting elements 55 will be described. The plurality of light emitting elements 55, as shown in a bottom plan view of the light emitting device 5 of FIG. 6, form two element columns 81*a*, 81*b*, which extend in the X direction and are spaced apart from each other in the Y direction. The element columns 81*a*, 81*b* each include the plurality of light emitting elements 55 that are aligned in the X direction at predetermined intervals.

The plurality of light emitting elements 55 in the element column 81*a* are mounted at predetermined intervals so as to extend over the width of the recording sheet of paper P in the X direction. In addition, the light emitting elements 55 in the element column 81*b* are mounted at positions that complement space between the adjacent light emitting elements 55 in the element column 81*a*. That is, as viewed in the Y direction, that is, as shown in FIG. 4A, the light emitting elements 55 in the element column 81*b* are positioned at space between the adjacent light emitting elements 55 in the element column 81*a*, and all the light emitting elements 55 are aligned at predetermined intervals in the X direction.

Figure 6:
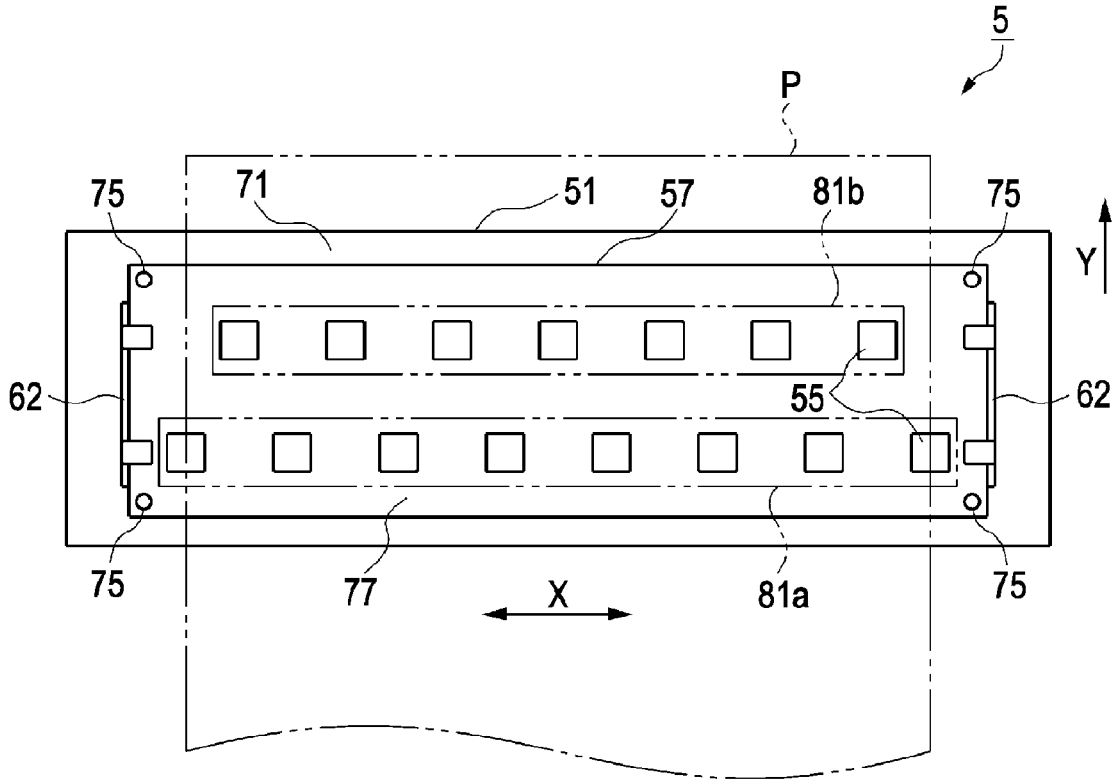
FIG. 6 is a bottom plan view of the light emitting device of the ink jet recording apparatus according to the embodiment of the invention.

Note that the substrate 57 has screw holes 75, as shown in FIG. 6, and screws (not shown) are inserted through the screw holes 75. Then, the screws (not shown) inserted in the screw holes 75 are fastened to the screw holes 74 of the above described cover 51. In this manner, the substrate 57 is fixed to the cover 51.

Each of the thermally conductive members 59 contains a high thermal conductive material, such as graphite, carbon fiber or metal, for example, and is formed into a sheet-like shape having a flexibility. Each of the thermally conductive members 59, as shown in FIG. 7, is stacked on the substrate 57 so that the thermally conductive member 59 is in contact with the second face 79.

Figure 8:
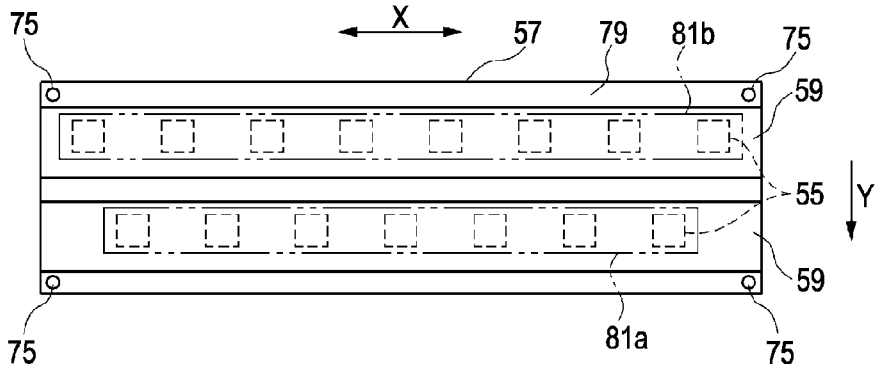
FIG. 8 is a plan view of the substrate and thermally conductive member of the light emitting device of the ink jet recording apparatus according to the embodiment of the invention.

In addition, each of the thermally conductive members 59, as shown in FIG. 8, includes a length equivalent to that of the substrate 57 in the X direction and has a size to extend over the light emitting elements 55 in the Y direction. That is, of the two thermally conductive members 59, one of the thermally conductive members 59 covers the element column 81*a* and the other covers the element column 81*b* from the side of the second face 79 of the substrate 57. In this manner, all the area of the second face 79 of the substrate 57, in which the light emitting elements 55 are stacked, are covered with the two thermally conductive member 59 on the second face 79 of the substrate 57.

Figure 7:
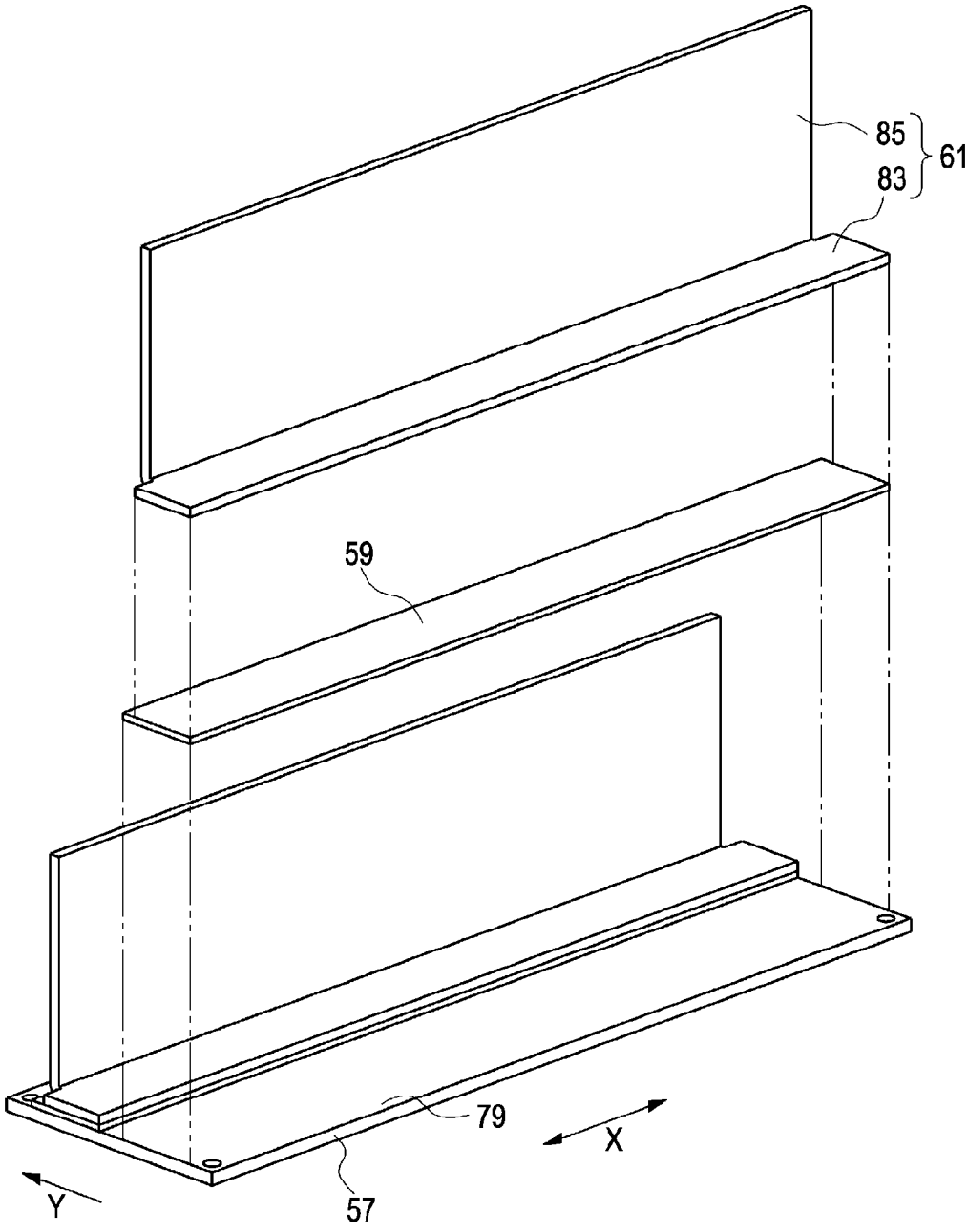
FIG. 7 is an exploded perspective view of a substrate, thermally conductive member and heat sink in the light emitting device of the ink jet recording apparatus according to the embodiment of the invention.

Each of the heat sinks 61, as shown in FIG. 7, includes a plate-like base portion 83 and a fin 85 that extends from one side periphery of the base portion 83, which is formed along the X direction, away from the thermally conductive member 59. The heat sinks 61 may be, for example, formed by bending a high thermal conductive material, such as aluminum.

Each of the base portions 83 has a length equivalent to the substrate 57 in the X direction and has a size to extend over the light emitting elements 55 in the Y direction. Then, each of the heat sinks 61 is stacked on the corresponding thermally conductive member 59 so that the base portion 83 is in contact with the thermally conductive member 59.

Figure 9:
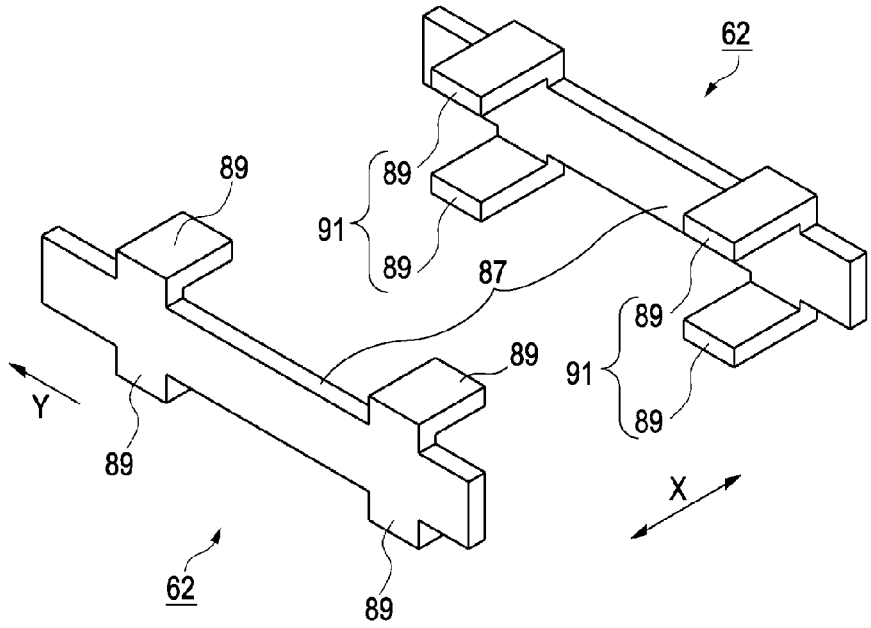
FIG. 9 is a perspective view of holding brackets in the light emitting device of the ink jet recording apparatus according to the embodiment of the invention.

Each of the holding brackets 62 is formed of, for example, a plate-like material that has a high plasticity, such as aluminum, and, as shown in FIG. 9, includes a plate-like proximal portion 87 that extends in the Y direction and four pawl portions 89 that extend from the proximal portion 87 in the X direction. Of the four pawl portions 89, two of them are formed at one side periphery of the proximal portion 87, which is formed along the Y direction and the other two are formed at the other side periphery.

Figure 10:
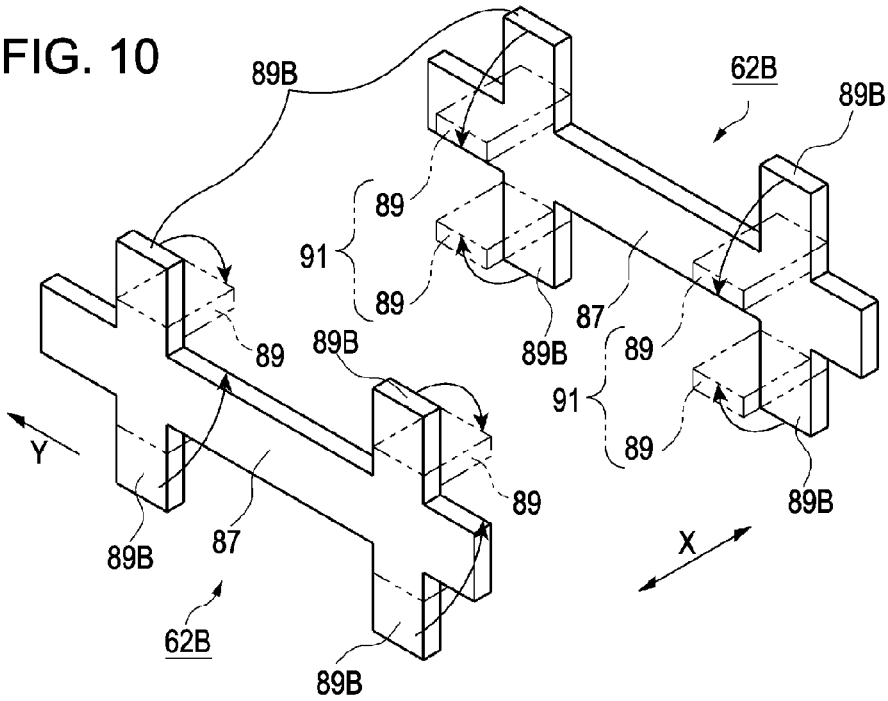
FIG. 10 is a perspective view of blank materials of the holding brackets in the light emitting device of the ink jet recording apparatus according to the embodiment of the invention.

In addition, the pawl portions 89 formed at the one side periphery are opposed to the pawl portions 89 formed at the other side periphery with the proximal portion 87 disposed in between. Then, each pair of pawl portions 89, which are formed on both side peripheries of the proximal portion 87 and opposed to each other, forms a set of holding portion 91. Each holding portion 91, as shown in FIG. 10, may be formed by bending pawl portions 89B of a blank material 62B of each holding bracket 62.

Figure 11:
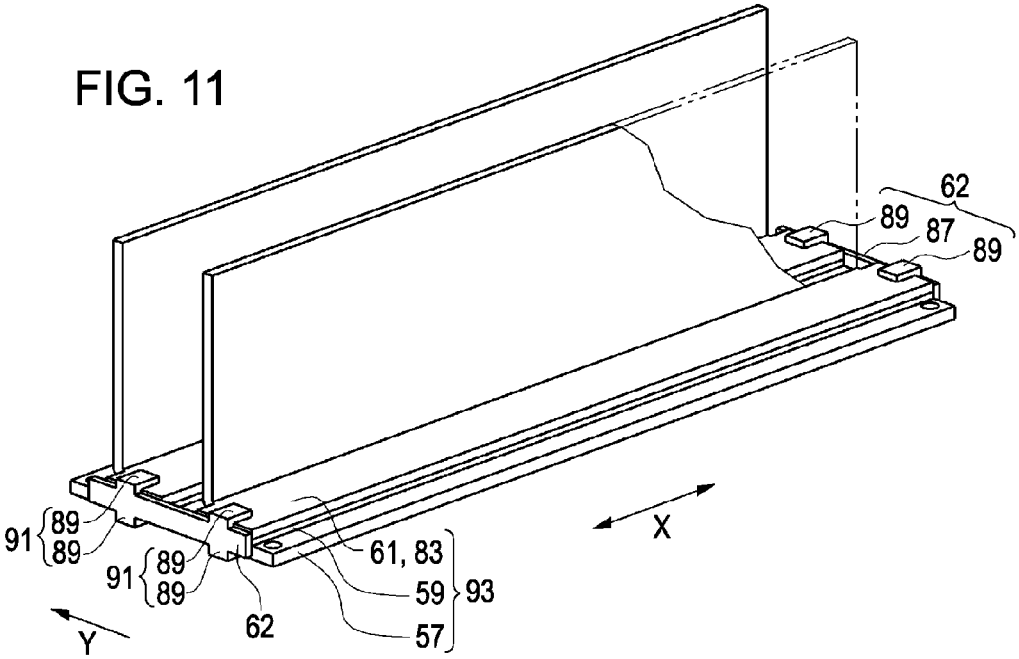
FIG. 11 is a view that illustrates a state where the substrate, the thermally conductive member and the heat sink are held in the light emitting device of the ink jet recording apparatus.

The thus configured two holding brackets 62, as shown in FIG. 11, each bind a stacked body 93 including the substrate 57, the thermally conductive member 59 and the heat sink 61 at each side periphery portion of the substrate 57 in the Y direction. Each of the holding portions 91 of the holding bracket 62 binds the substrate 57, the thermally conductive member 59 and the base portion 83 of the heat sink 61 at each side periphery portion of the stacked body 93 in the Y direction.

The thus configured light emitting device 5, as shown in FIG. 1, is arranged downstream of the recording head 13 in the Y direction, which is the feed direction in which the recording sheet of paper P is fed. In addition, the light emitting device 5, as shown in FIG. 4A and FIG. 4B, has the exhaust holes 69 that are directed toward the downstream side in the Y direction, and is arranged in a state where a clearance is maintained between the plurality of light emitting elements 55 and the recording sheet of paper P.

Figure 12:
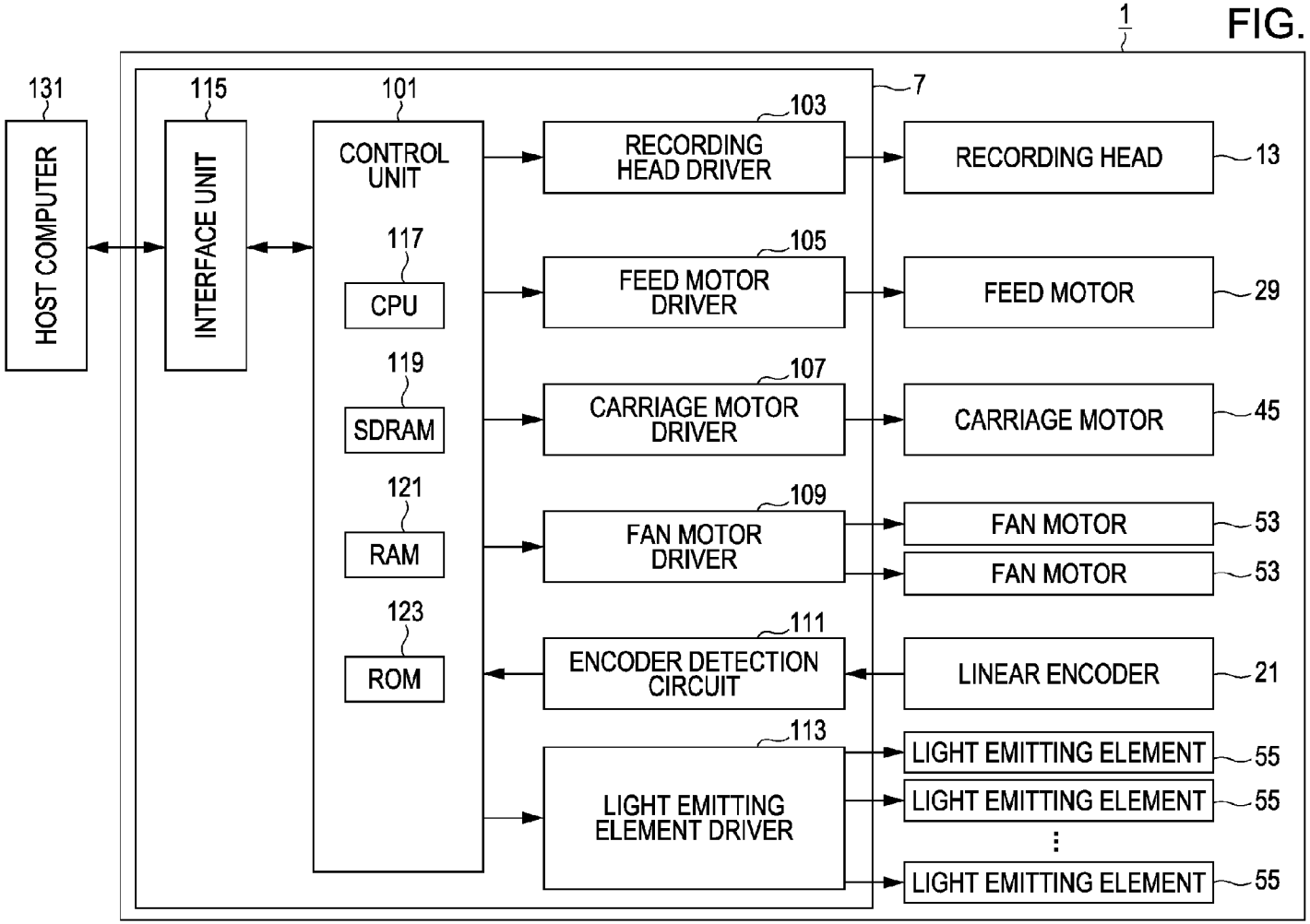
FIG. 12 is a block diagram that schematically shows the configuration of the ink jet recording apparatus according to the embodiment of the invention.

The control circuit 7, as shown in FIG. 12, includes a control unit 101, a recording head driver 103, a feed motor driver 105, a carriage motor driver 107, a fan motor driver 109, an encoder detection circuit 111, a light emitting element driver 113 and an interface unit 115.

The control unit 101 is formed of, for example, a microcomputer, and includes a CPU (central processing unit) 117, an SDRAM (synchronous dynamic random access memory) 119, a RAM (random access memory) 121 and a ROM (read-only memory) 123.

The CPU 117 executes various processes, such as a recording process. The SDRAM 119 stores recording data that are input from a host computer 131 through the interface unit 115. The RAM 121 temporarily expands a program, such as a recording process, executed by the CPU 117 or temporarily stores various types of data. The ROM 123 is, for example, formed of a nonvolatile semiconductor memory and stores a program, or the like, executed by the CPU 117.

The recording head driver 103 outputs a driving signal to the recording head 13 on the basis of instructions from the CPU 117 and controls driving of the recording head 13. The feed motor driver 105 controls the feed motor 29 on the basis of instructions from the CPU 117.

The carriage motor driver 107 controls the carriage motor 45 on the basis of instructions from the CPU 117. The fan motor driver 109 controls the fan motors 53 on the basis of instructions from the CPU 117.

The encoder detection circuit 111 detects a detection signal sent from the linear encoder 21 and outputs the detected result to the control unit 101. The light emitting element driver 113 controls an on/off state of each of the light emitting elements 55 on the basis of instructions from the CPU 117.

The interface unit 115 outputs recording data regarding characters and/or images to be recorded, which are received from the host computer 131, to the control unit 101 or outputs various pieces of information received from the control unit 101 to the host computer 131.

In the thus configured ink jet recording apparatus 1, driving of the feed motor 29 is controlled by the control unit 101 and the feed device 11 intermittently feeds the recording sheet of paper P in the Y direction while having the recording sheet of paper P opposed to the recording head 13. At this time, the control unit 101 controls driving of the recording head 13 to discharge ink droplets at a predetermined position while controlling driving of the carriage motor 45 to reciprocally move the carriage 15 in the X direction on the basis of a position detection signal sent from the linear encoder 21. By such operation, dots are formed on the recording sheet of paper P and an image formation based on recording information, such as image data, is performed on the recording sheet of paper P.

The recording sheet of paper P, on which the image is formed, is guided to a position opposed to the plurality of light emitting elements 55 of the light emitting device 5. Then, the light emitting device 5 irradiates light to the recording sheet of paper P that is opposed to the plurality of light emitting elements 55 in such a manner that the control unit 101 controls on states of the plurality of light emitting elements 55. Ink that composes the image formed on the recording sheet of paper P is promoted to harden by receiving light emitted from the light emitting elements 55.

Then, the recording sheet of paper P that has received light irradiated from the light emitting device 5 is delivered outside the ink jet recording apparatus 1. Thus, recording on one recording sheet of paper P is completed.

Note that light emission of the light emitting elements 55 may involve heat generation. Heat from each of the light emitting elements 55 is conducted through the substrate 57, the thermally conductive member 59 to the heat sink 61 in the stated order. Then, heat that has reached the heat sink 61 is radiated from the heat sink 61 into air inside the cover 51.

Then, the fan motors 53 are driven and outside air is introduced through the air intake holes 65 of the cover 51 into the cover 51, while air inside the cover 51 is exhausted through the exhaust holes 69 toward the downstream side in the Y direction. In this manner, the flow of air is generated inside the cover 51 and heat radiation from the heat sinks 61 is promoted.

Note that the above described fan motors 53 are arranged at positions where outside air introduced into the cover 51 may be directly brought to the two heat sinks 61. In this manner, it is possible to further promote radiation of heat from the heat sinks 61.

Figure 13A:
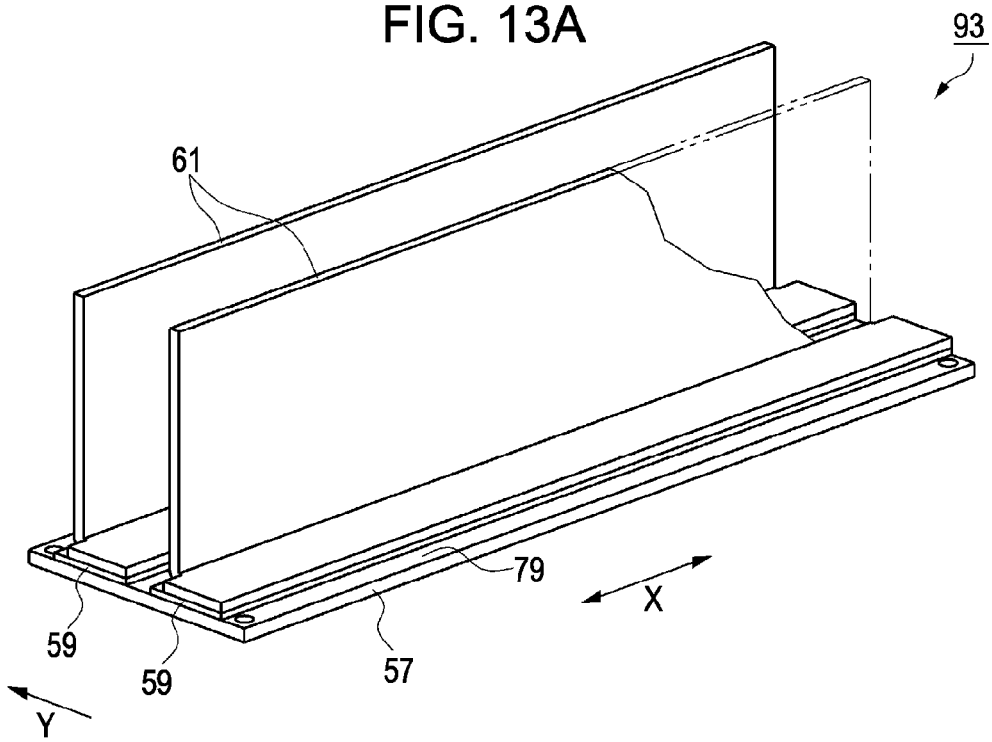
FIG. 13A and FIG. 13B are views that illustrate a method of manufacturing the light emitting device of the ink jet recording apparatus according to the embodiment of the invention.

Here, a method of manufacturing the light emitting device 5 will be described. As shown in FIG. 13A, the two thermally conductive members 59 are mounted on the second face 79 of the substrate 57 on which the plurality of light emitting elements 55 are mounted on the first face 77 thereof, and, in addition, the base portion 83 of each heat sink 61 is mounted on the corresponding thermally conductive member 59, thus forming the stacked body 93.

Figure 13B:
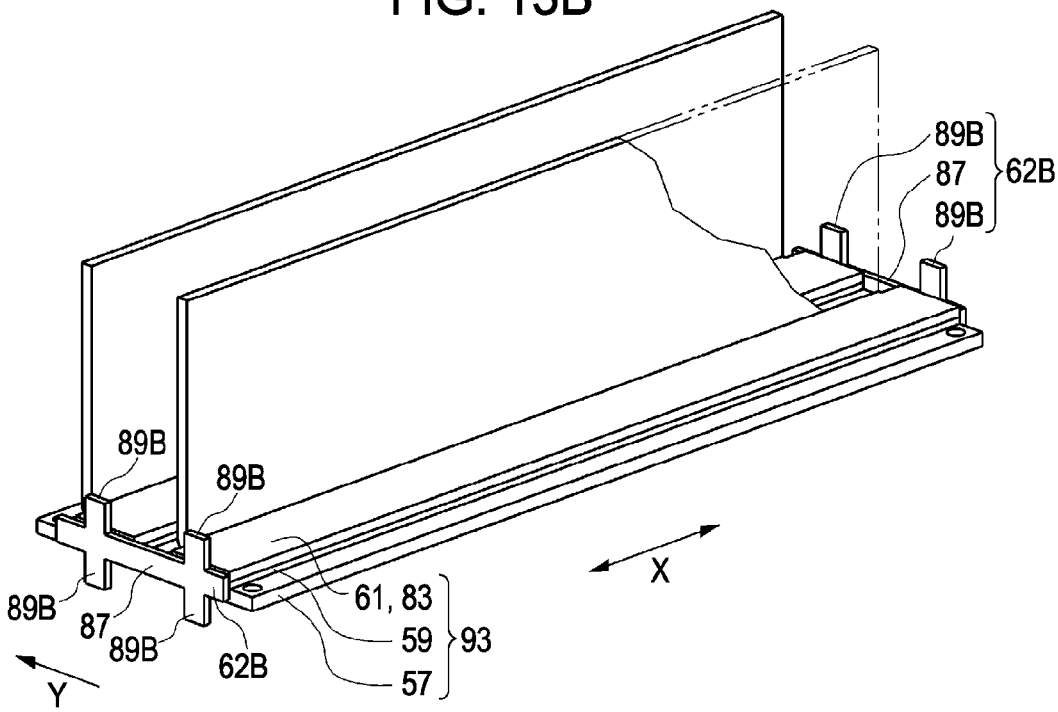

Subsequently, as shown in FIG. 13B, each of the blank materials 62B is arranged so that the proximal portion 87 is opposed to each side periphery of the stacked body 93, which is formed along the Y direction. Then, each blank material 62B is arranged so that the pair of pawl portions 89B that form each of the holding portion 91 shown in FIG. 10 overlaps the thermally conductive member 59 and the base portion 83 of the heat sink 61 as viewed in the X direction. In addition, the proximal portion 87 of each blank material 62B may be in contact with the side periphery of the stacked body 93 in the Y direction or may be spaced apart from the side periphery of the stacked body 93 in the Y direction.

Then, by means of pressing, or the like, the pawl portions 89*b* of the blank material 62B are bent toward the stacked body 93 to form the holding portions 91, so that, as shown in FIG. 11, the stacked body 93 is bound by the two holding brackets 62.

After that, the two heat sinks 61 and the two thermally conductive members 59 are inserted into the insertion opening 73 of the cover 51 from the side of the two heat sinks 61, and then the substrate 57 is fixed to the lower face 71 of the cover 51 by means of a screw or the like. Thus, the light emitting device 5, as shown in FIG. 6, is finished.

Note that, when a notch or a dent is formed along a bending line of each pawl portion 89B in the blank material 62B, force required for bending may be reduced or the accuracy of bending position may be improved.

In the present embodiment, the recording head 13 may be regarded as a discharge head, the light emitting element 55 may be regarded as a light emitting body, the heat sink 61 may be regarded as a heat radiation member, the fan motor 53 may be regarded as an air intake fan, or a blower, the blank material 62B may be regarded as a plate material, and the exhaust hole 69 may be regarded as an exhaust port.

In the ink jet recording apparatus 1 according to the present embodiment, the light emitting device 5 includes the stacked body 93 in which the sheet-like thermally conductive member 59 is interposed between the second face 79 of the substrate 57, on which the plurality of light emitting elements 55 are surface-mounted on the first face 77 thereof, and the base portions 83 of the heat sinks 61. In the stacked body 93, the thermally conductive members 59 are in contact with both the second face 79 of the substrate 57 and the base portions 83 of the heat sinks 61. Therefore, even when the plurality of light emitting elements 55 heat up and the substrate 57 is then heated, heat of the substrate 57 tends to be promptly conducted to the heat sinks 61 through the thermally conductive members 59.

In addition, because the thermally conductive members 59 are sheet-like, close adhesion to the substrate 57 and the heat sinks 61 is enhanced. Thus, it is possible to promptly conduct heat of the substrate 57 to the heat sinks 61.

In addition, each of the heat sinks 61 has the fin 85 that is formed so as to extend from the base portion 83 away from the thermally conductive member 59. Thus, the heat sink 61 increases a surface area by which the heat sink 61 is in contact with air, and it is possible to promptly radiate heat, which is conducted through the thermally conductive member 59 to the base portion 83, into air. That is, the light emitting device 5 is able to efficiently radiate heat from the plurality of light emitting elements 55. Accordingly, it is possible to reduce a need to actively cool the plurality of light emitting elements 55.

In addition, the light emitting device 5 includes the cover 51 and the fan motors 53. The cover 51 covers the heat sinks 61 and thermally conductive members 59 of the stacked body 93. The fan motors 53 introduce outside air through the air intake holes 65 formed in the top plate face 63 of the cover 51 into the cover 51. The exhaust holes 69 are formed in the front face 67 of the cover 51 so as to exhaust air inside the cover 51 toward the downstream side in the Y direction.

With this configuration, it is possible to introduce outside air into the cover 51, and it is possible to generate the flow of air inside the cover 51. Thus, it is possible to further promptly radiate heat from the heat sinks 61. Furthermore, because air inside the cover 51 is exhausted toward the downstream side in the Y direction than the recording head 13, it is possible to suppress curved flying of ink droplets to a lesser degree.

In addition, in the light emitting device 5, each of the fan motors 53 is formed of an air intake fan that introduces outside air into the cover 51 and is arranged at a position where the introduced outside air may be directly brought to the heat sink 61. Thus, it is possible to further promote radiation of heat from the heat sinks 61.

In addition, in the light emitting device 5, the stacked body 93 is bound by the holding portions 91 of the holding brackets 62 at the side peripheries in the Y direction. In this manner, without using bond, such as glue or adhesive, it is possible to fix the substrate 57, the thermally conductive members 59 and the heat sinks 61 one another.

The substrate 57, the thermally conductive members 59 and the heat sinks 61, when they can be fixed without using glue or adhesive, are less likely to receive resistance when they thermally expand. Thus, it is possible to suppress the occurrence of deformation, such as a warp or a curve, in the stacked body 93 due to a difference in coefficient of thermal expansion among the substrate 57, the thermally conductive members 59 and the heat sinks 61, so that reliability of the light emitting device 5 is improved.

Note that, in the present embodiment, the stacked body 93 is formed so that the thermally conductive members 59 and the heat sinks 61 are mounted on the substrate 57 on which the plurality of light emitting elements 55 are mounted; however, the order of mounting of the plurality of light emitting elements 55 and the configuration of the stacked body 93 is not limited to it. That is, it is applicable that, after the stacked body 93 is bound by the holding brackets 62, the plurality of light emitting elements 55 are mounted on the first face 77 of the substrate 57. In this manner, it is possible to radiate heat used in mounting process from the heat sinks 61, and it is possible to suppress the light emitting elements 55 from being damaged by heat used in mounting process.

In addition, in the present embodiment, after the thermally conductive members 59 are mounted on the substrate 57, the heat sinks 61 are mounted on the thermally conductive members 59. However, a method of configuration of the stacked body 93 is not limited to it. For example, the side of the second face 79 of substrate 57 may be mounted on the thermally conductive members 59 after the thermally conductive members 59 are mounted on the heat sinks 61, or the thermally conductive members 59 may be mounted on the substrate 57 in a state where the heat sinks 61 are mounted on the thermally conductive member 59. Thus, various methods may be employed.

Furthermore, in the present embodiment, each of the blank materials 62B is arranged opposite the side periphery of the stacked body 93 and then the four pawl portions 89*b* of each blank material 62B are bent, so that the stacked body 93 is bound by the holding brackets 62. However, a direction in which the stacked body 93 is bound is not limited to it.

Figure 14A:
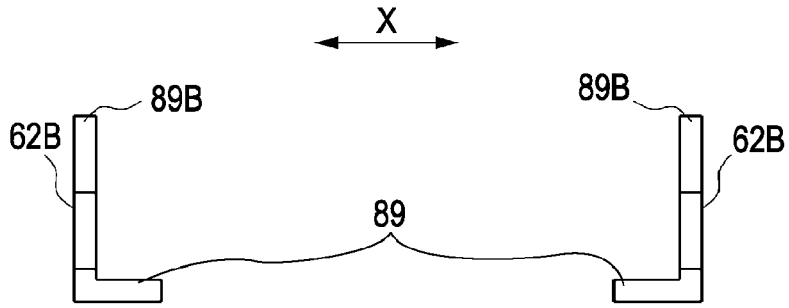
FIG. 14A to FIG. 14C are views that illustrate another example of a method of manufacturing the light emitting device of the ink jet recording apparatus according to the embodiment of the invention.
Figure 14B:
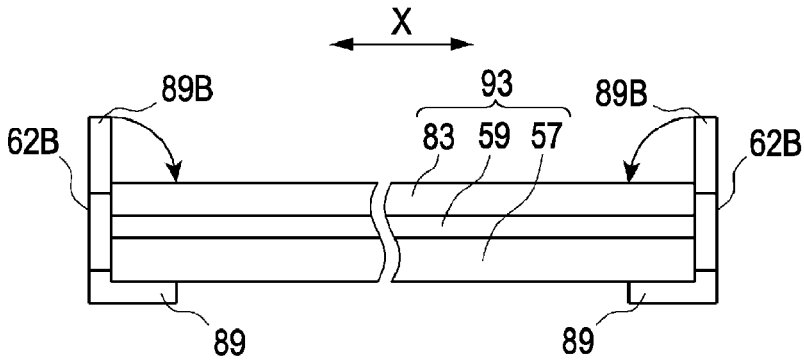
Figure 14C:
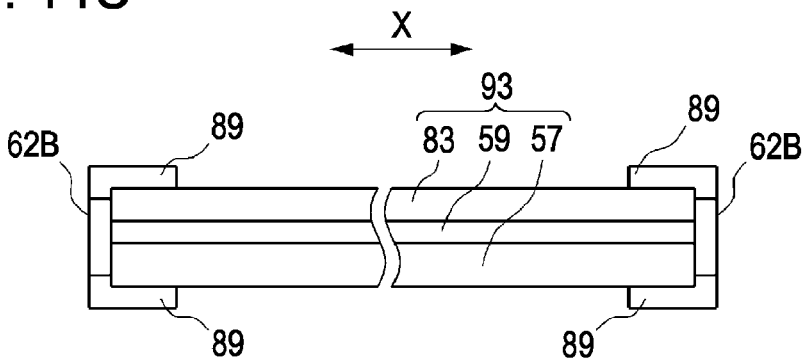

For example, as shown in FIG. 14A, in each of the blank materials 62B, the pawl portions 89 on the lower side in the drawing are only bent. Subsequently, as shown in FIG. 14B, the stacked body 93 is mounted on the pawl portions 89 of the blank materials 62B. After that, as shown in FIG. 14C, the pawl portions 89B on the upper side are bent toward the stacked body 93.

According to this method, because the stacked body 93 may be supported by the previously bent pawl portions 89, it is possible to easily adjust the position of arrangement of the blank materials 62B relative to the stacked body 93.

Figure 15A:
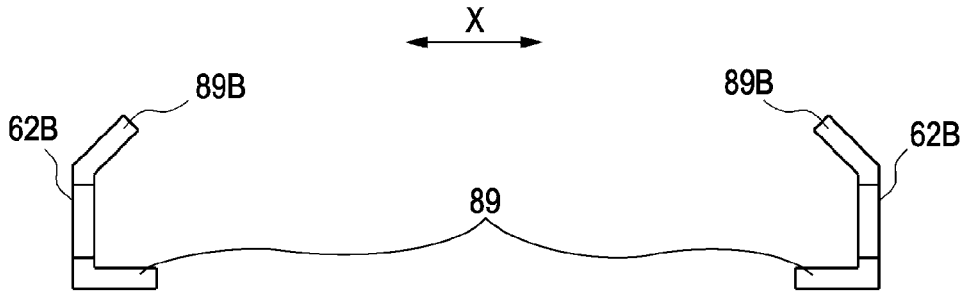
FIG. 15A to FIG. 15C are views that illustrate yet another example of a method of manufacturing the light emitting device of the ink jet recording apparatus according to the embodiment of the invention.
Figure 15B:
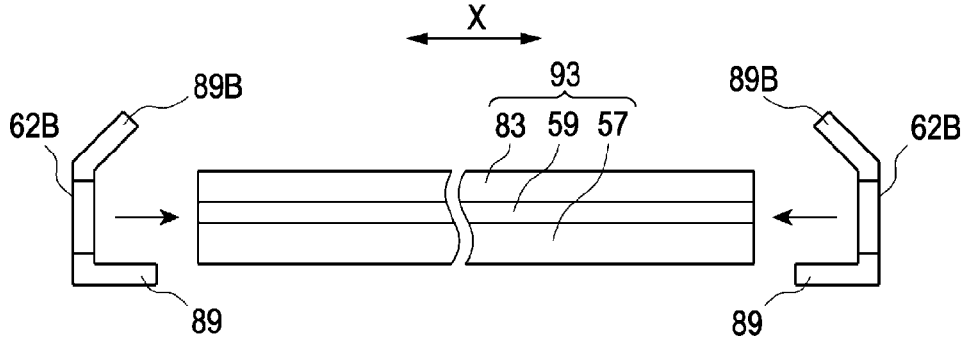
Figure 15C:
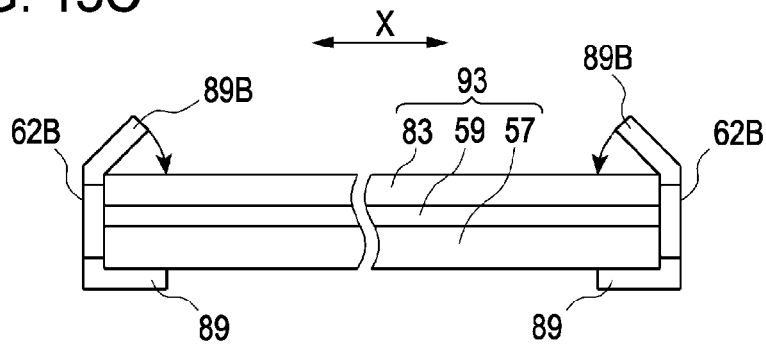

Furthermore, in another example, as shown in FIG. 15A, in each of the blank materials 62B, the pawl portions 89 on the lower side in the drawing are only bent, and the pawl portions 89B on the upper side are bent partway. Subsequently, as shown in FIG. 15B, the blank materials 62B are arranged relative to the stacked body 93 so that the pawl portions 89 and pawl portions 89B of the blank materials 62B wrap the side peripheries of the stacked body 93 from the outside of the side peripheries. After that, as shown in FIG. 15C, the pawl portions 89B which have been bent partway are bent toward the stacked body 93.

According to this method, when the blank materials 62B are arranged relative to the stacked body 93, it is possible to supplementarily position the stacked body 93 by the pawl portions 89 and the partway bent pawl portions 89B. Thus, when the stacked body 93 is going to be held by bending the pawl portions 89B, it is possible to suppress a deviation in position of the thermally conductive members 59 and/or heat sinks 61 relative to the substrate 57.

Note that, in the examples shown in FIG. 14A to FIG. 15C, the stacked body 93 is configured so that the substrate 57 is positioned on the lower side as viewed in the drawings; however, it is applicable that the base portions 83 of the heat sinks 61 are positioned on the lower side.

Figure 16:
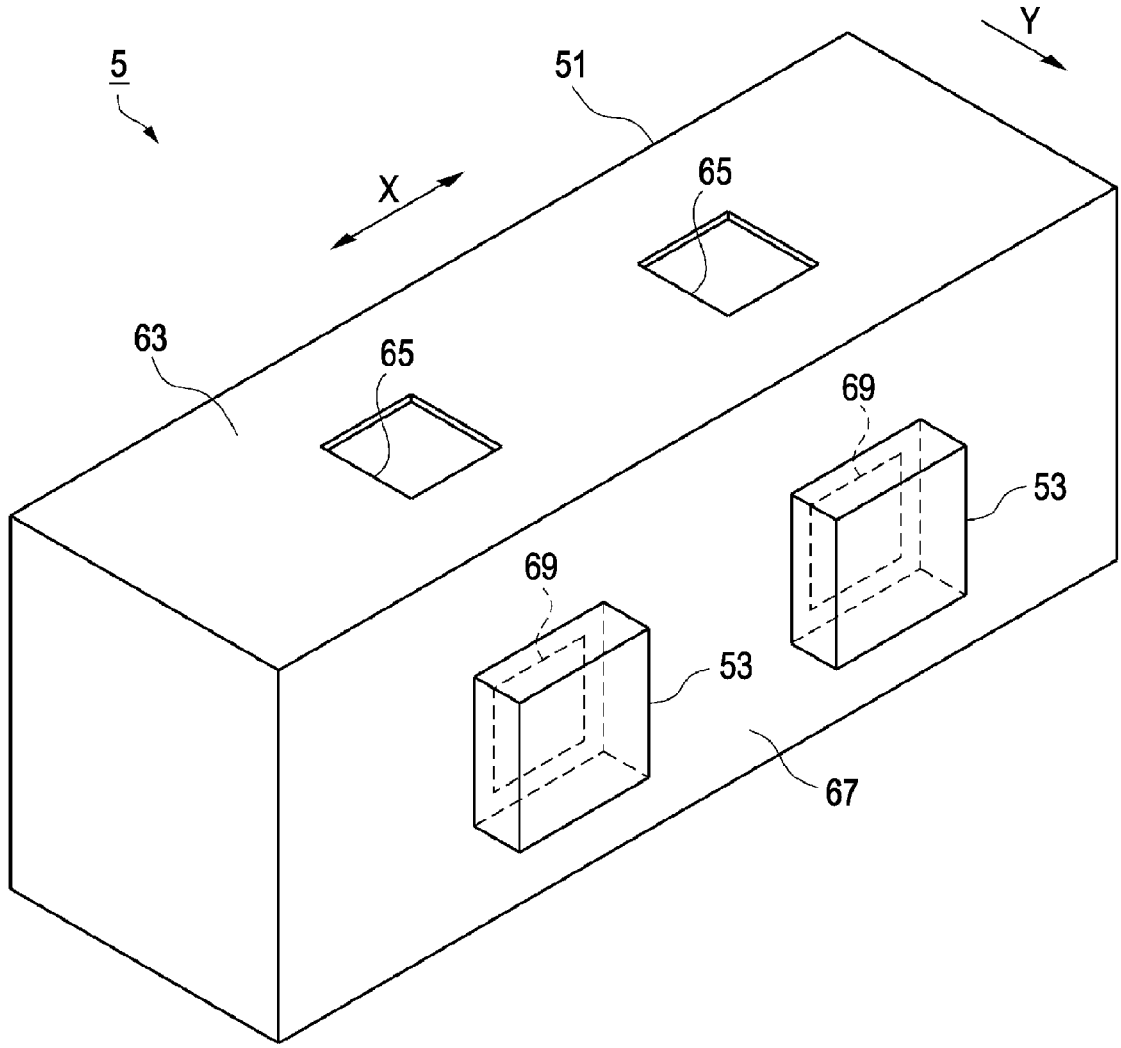
FIG. 16 is a view that illustrates another example of the configuration of the light emitting device of the ink jet recording apparatus according to the embodiment of the invention.

Furthermore, in the present embodiment, in the light emitting device 5, outside air is introduced through the air intake holes 65 into the cover 51 by the fan motors 53; however, it is not limited to it. Air inside the cover 51 may be discharged through the exhaust holes 69 to outside the cover 51. In this case, as shown in FIG. 16, it is only necessary that the fan motors 53 are arranged at positions so as to cover the exhaust holes 69, and the rotation of the fan motors 53 is controlled in a direction in which air inside the cover 51 is discharged to outside the cover 51.

Figure 17:
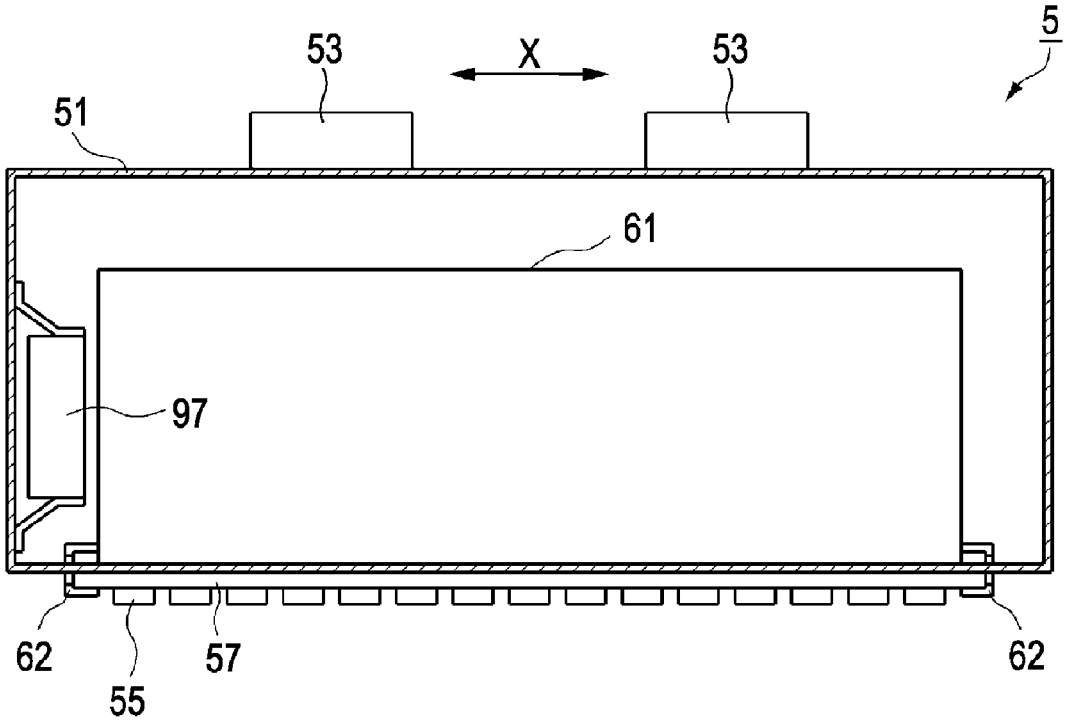
FIG. 17 is a view that illustrates yet another example of the configuration of the light emitting device of the ink jet recording apparatus according to the embodiment of the invention.

In addition, the light emitting device 5, as shown in FIG. 17, may include an additional blowing fan 97 provided inside the cover 51. In this case, the blowing fan 97 is arranged to blow air toward the heat sinks 61 and to blow air in a direction that intersects the air intake direction of the fan motors 53.

With this configuration, outside air from the fan motors 53 are blown from the upper side to the lower side relative to the heat sinks 61, as viewed in FIG. 17, and then flown in the X direction by the blowing fan 97. Thus, outside air may be brought over large areas of the heat sinks 61, and it is possible to further promote radiation of heat.

In addition, the number of fan motors 53, the number of air intake holes 65 and the number of exhaust holes 69 are not limited to two, but they may be arbitrarily determined.

Furthermore, the recording medium is not limited to the recording sheet of paper P. As long as dots may be formed by adhering ink droplets, it is possible to use various materials, such as metal or resin.

Moreover, the colors of ink are not limited to yellow, magenta, cyan and black. Five colors of ink that further includes white in addition to the above four colors, six colors that further includes light cyan and light magenta in addition to the above four colors, or the like, may be arbitrarily employed.

What is claimed is:

1. The ink jet recording apparatus comprising:

a substrate that has a first face and a second face which is a face opposite to the first face;

a light emitting body that is held on a side of the first face of the substrate and that emits light;

a thermally conductive member that is provided so as to be in contact with the second face of the substrate and that contains a thermal conductive material;

a heat radiation member that is provided so as to be in contact with the thermally conductive member and that radiates heat conducted from the substrate through the thermally conductive member;

a discharge head that discharges ink, which hardens by receiving light emitted from the light emitting body, toward a recording medium;

a feed device that feeds the recording medium while having the recording medium opposed to the discharge head;

a cover that covers and encloses the thermally conductive member and the heat radiation member while the light emitting body is exposed; and a blower that introduces outside air present outside the cover into the cover, wherein the light emitting device is arranged downstream of the discharge head in a direction in which the recording medium is fed so that the light emitting body, which is exposed from the cover, is opposed to the recording medium fed by the feed device, and wherein the cover has a face with an exhaust port formed in the downstream side of the cover so as to exhaust air inside the cover toward the downstream side of the discharge head, and wherein the light emitting device irradiates the light to the ink that is discharged from the discharge head and adhered to the recording medium.

2. The light emitting device according to claim 1, wherein the thermally conductive member is formed into a sheet-like shape, wherein the thermally conductive member covers a region that overlaps the light emitting body in plan view, and wherein the thermally conductive member is held between the second face and the heat radiation member.

3. The light emitting device according to claim 1, wherein the heat radiation member is provided with a fin that extends away from the thermally conductive member.

4. The light emitting device according to claim 1, wherein the substrate, the thermally conductive member and the heat radiation member are bound by a holding bracket.

5. The ink jet recording apparatus according to claim 1, wherein the blower is an air intake fan that introduces the outside air into the cover.

* * * * *